US005769596A

United States Patent [19]

Burton

[11] Patent Number: 5,769,596

[45] Date of Patent: Jun. 23, 1998

[54] ELECTRICALLY ACTUATED QUICK-CONNECT COUPLER

[75] Inventor: Paul Burton, Lee, Ill.

[73] Assignee: Farmers' Factory Co., Lee, Ill.

[21] Appl. No.: 696,142

[22] Filed: Aug. 13, 1996

Related U.S. Application Data

[63] Continuation of Ser. No. 301,175, Sep. 6, 1994, abandoned.

[51] Int. Cl.[6] ..... E02F 5/14

[52] U.S. Cl. ..... 414/723; 37/468

[58] Field of Search ..... 414/723, 685, 414/686, 680; 37/468

[56] References Cited

U.S. PATENT DOCUMENTS

| | | | |
|---|---|---|---|
| 3,760,883 | 9/1973 | Birk | 414/723 X |
| 4,329,797 | 5/1982 | Shumaker | 414/685 |
| 4,798,511 | 1/1989 | Kaczmarczyk et al. | 414/686 |
| 4,955,779 | 9/1990 | Knackstedt | 403/324 X |
| 5,419,673 | 5/1995 | Merhar | 414/723 |

OTHER PUBLICATIONS

Cover page and pp. 3 and 4 of a brochure published Oct. 1992 and entitled Warner Electrak® Linear Actuator System.

*Primary Examiner*—Donald W. Underwood
*Attorney, Agent, or Firm*—Leydig, Voit & Mayer, Ltd.

[57] ABSTRACT

The coupler is attached to the boom of a tractor or other vehicle and enables the boom to be quickly and automatically connected to and disconnected from an implement such as a loader bucket. The coupler includes laterally shiftable pins that are moved into and out of latching relation with the implement by a linear actuator powered by an electric motor which may be quickly and easily connected with the electrical system of the vehicle.

2 Claims, 3 Drawing Sheets

ELECTRICALLY ACTUATED QUICK-CONNECT COUPLER

This is a continuation of application Ser. No. 08/301,175 filed on Sep. 6, 1994, now abandoned.

BACKGROUND OF THE INVENTION

This invention relates to couplings of the type used to mount detachable farm or construction implements on the free end of a movable boom of a tractor, loader or the like.

For many years, the assignee of the present invention has made quick-attach couplings adapted for connection to the boom and having spring-loaded pins which, when the coupling approaches the implement, are cammed laterally inwardly toward unlatched positions and then spring laterally outwardly into latching engagement with the implement. As a result, the boom may be connected to the implement automatically simply by moving the boom and the attached coupling toward the implement and without performing any manual operation.

Unlatching of the implement from the coupling is effected by manually turning an actuator from a normal position to an unlatched position in order to retract the pins to their unlatched positions. This requires the operator to leave the vehicle in order to turn the actuator.

Couplings have been made in which the pins are shifted between their latched and unlatched positions by hydraulic actuators. While systems of this type avoid the need of the operator leaving the vehicle to either latch or unlatch the pins, it is very time consuming to establish hydraulic connections between the hydraulic actuators of the coupler and the hydraulic system of the vehicle. In a typical hydraulic coupler, several hours are required to marry the hydraulic systems of the coupler and the vehicle each time the coupler is installed on the vehicle.

SUMMARY OF THE INVENTION

The general aim of the present invention is to provide a new and improved coupler in which the pins are shifted between their latched and unlatched positions by an electrical actuator which may be quickly and easily connected with the electrical system of the vehicle.

A more detailed object of the invention is to achieve the foregoing through the provision of a coupler having a reversible electric motor which acts through a linear actuator to effect shifting of the pins between their positions.

These and other objects and advantages of the invention will become more apparent from the following detailed description when taken in conjunction with the accompanying drawings.

Figure 1:
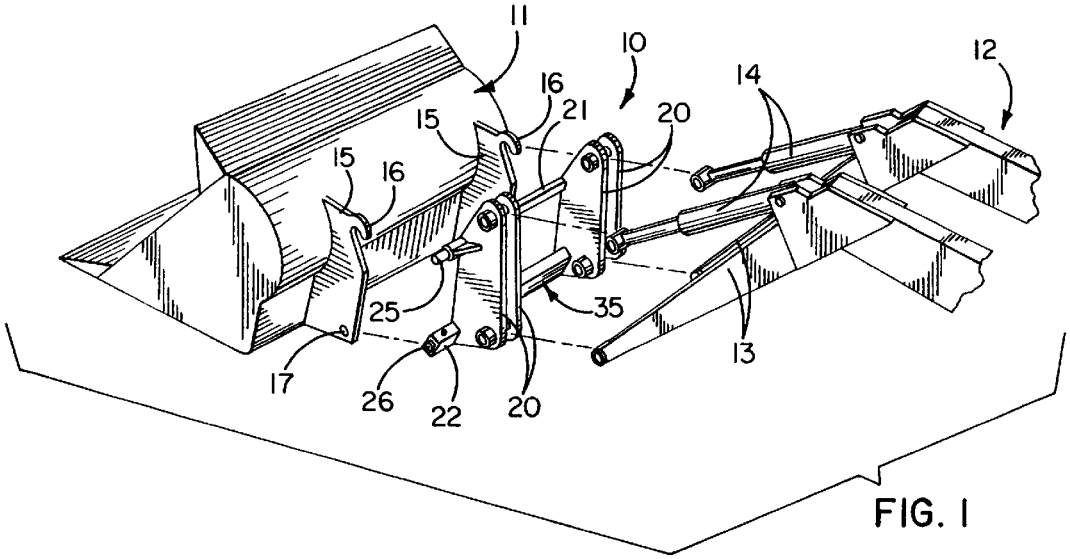
FIG. 1 is an exploded perspective view of a typical boom and a typical implement adapted to be connected by a new and improved coupling incorporating the unique features of the present invention.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the invention has been shown in the drawings as embodied in a coupling 10 used to mount an implement such as a loader bucket 11 on the free end of a movable boom 12, the latter being connected at its other end to a loader or tractor (not shown). The boom which has been illustrated includes a pair of laterally spaced arms 13 adapted to be pivoted upwardly and downwardly relative to the tractor. Reciprocating hydraulic actuators 14 are carried by the arms and are used to rock the bucket between various positions.

The bucket 11 is of conventional construction and includes a rear wall which carries two laterally spaced and generally vertical mounting plates 15. Each plate includes an upper hook 16 and is formed with a lower laterally extending hole 17 with a bushing (not shown) therein.

As shown most clearly in FIG. 1, the coupler 10 comprises two laterally spaced pair of laterally spaced and upright brackets 20. The four brackets are rigidly connected near their upper ends by a laterally extending bar 21 and are connected near their lower ends by a housing member 22. The lower end portions of the arms 13 of the boom 12 are adapted to be sandwiched between the lower end portions of the brackets 20 and are pivotally connected thereto by pins 23, one of which is visible in FIG. 2. Similarly, the rods of the actuators 14 are adapted to be inserted between the upper end portions of the brackets 20. Pins 24, one of which is visible in FIG. 2, pivotally attach the rods of the actuators to the brackets. Thus, the pins 23 and 24 serve to detachably connect the coupler 10 to the boom 12.

Figure 2:
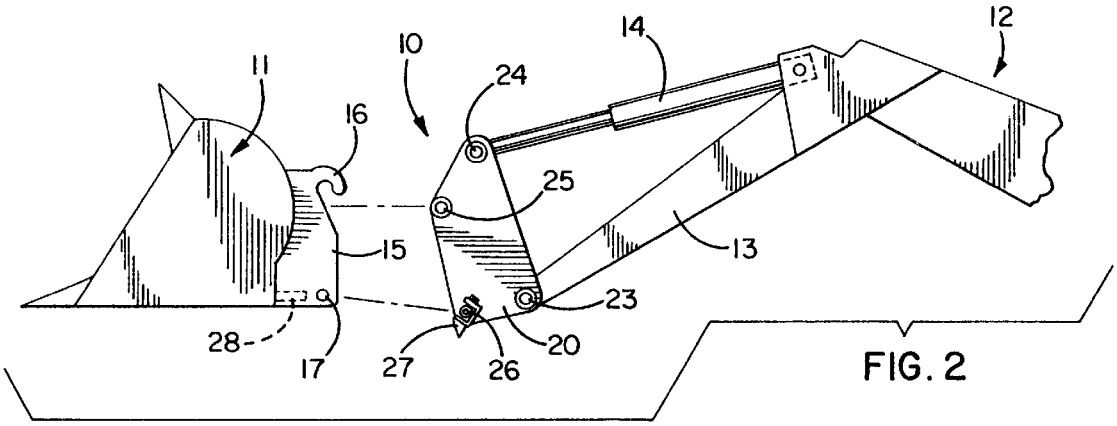
FIG. 2 is a side elevational view showing the coupling connected to the boom and in position to be connected to the implement.
Figure 3:
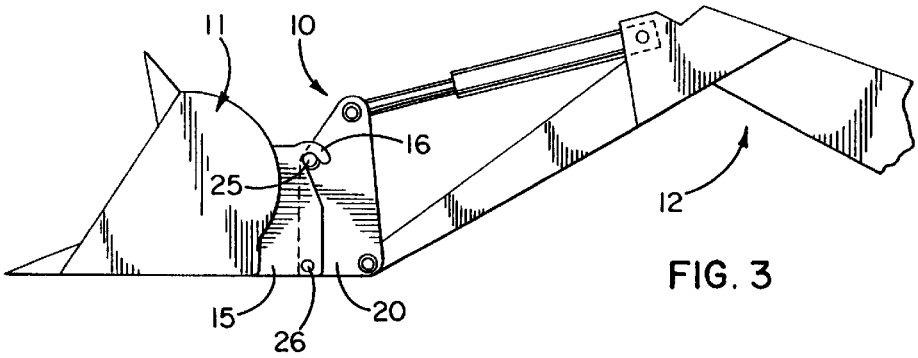
FIG. 3 is a view similar to FIG. 2 but shows the coupling attached to the implement.

In order to connect the coupler 10 to the bucket 11, the upper end portion of the outboard bracket 20 of each pair carries a fixed and laterally outwardly projecting connector or pin 25. When the coupler 10 is in a downwardly rocked position as shown in FIG. 2, the pins 25 move beneath the hooks 16 of the bucket as the coupler is moved forwardly toward the bucket. Once the pins 25 have been located beneath the hooks, the coupler is raised upwardly to cause the pins to move into latching engagement with the hooks.

Figure 4:
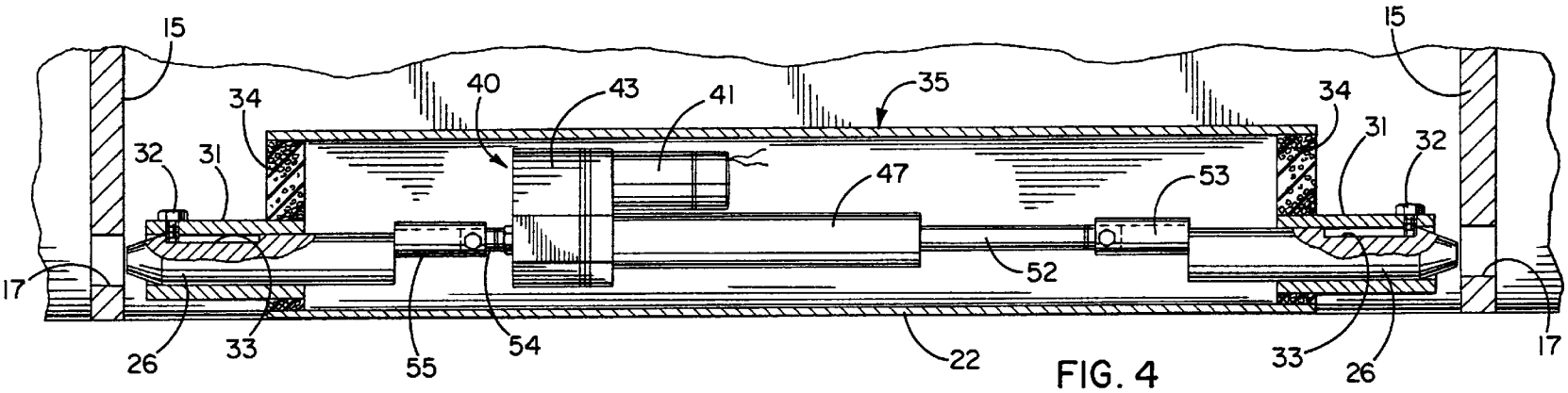
FIG. 4 is an enlarged fragmentary cross-sectional view of a portion of the coupler and shows the latching pins in unlatched positions.
Figure 7:
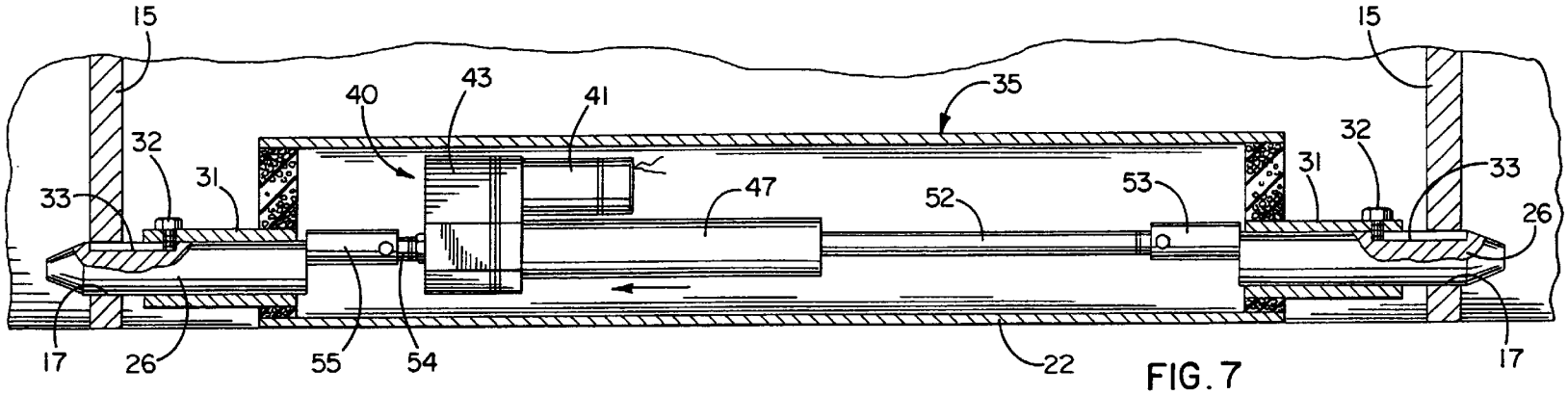
FIG. 7 also is a view similar to FIG. 4 but shows both latching pins in latched positions.

In addition to the upper pins 25, the coupler 10 carries a lower pair of laterally outwardly extending connectors or pins 26 which are adapted to latch into the holes 17 in the plates 15. As the coupler is shifted forwardly toward the bucket 11, the pins 26 are held in retracted, unlatched positions (FIG. 4). When the coupler is raised to locate the pins 25 within the hooks 16, the pins 26 move into alignment with the holes 17 and then are shifted laterally outwardly into the holes so as to latch the lower end of the coupler to the bucket (see FIG. 7). During forward shifting of the coupler toward the bracket, blocks 27 on the forward side of the end portions of the housing member 22 engage blocks 28 on the inboard sides of the plates 15 to stop forward shifting of the coupler when the pins 26 are aligned horizontally with the holes 17. In addition, the blocks 27 and 28 transmit pushing and lifting forces from the coupler to the bucket and relieve such forces from the pins 26.

The housing member 22 is fixed to the brackets 20 and is adapted to be closed by a cover (not shown) suitably connected to the housing member. Sleeves 31 (FIG. 4) fixed to the ends of the housing member guide the pins 26 for inward and outward sliding while screws 32 on the sleeves project into slots 33 in the pins to prevent rotation of the pins. The ends of the cover carry foam gaskets 34 which seal against the sleeves to restrict the entry of dirt and other contamination into the housing 35 defined by the fixed housing member 22 and the cover.

Figure 5:
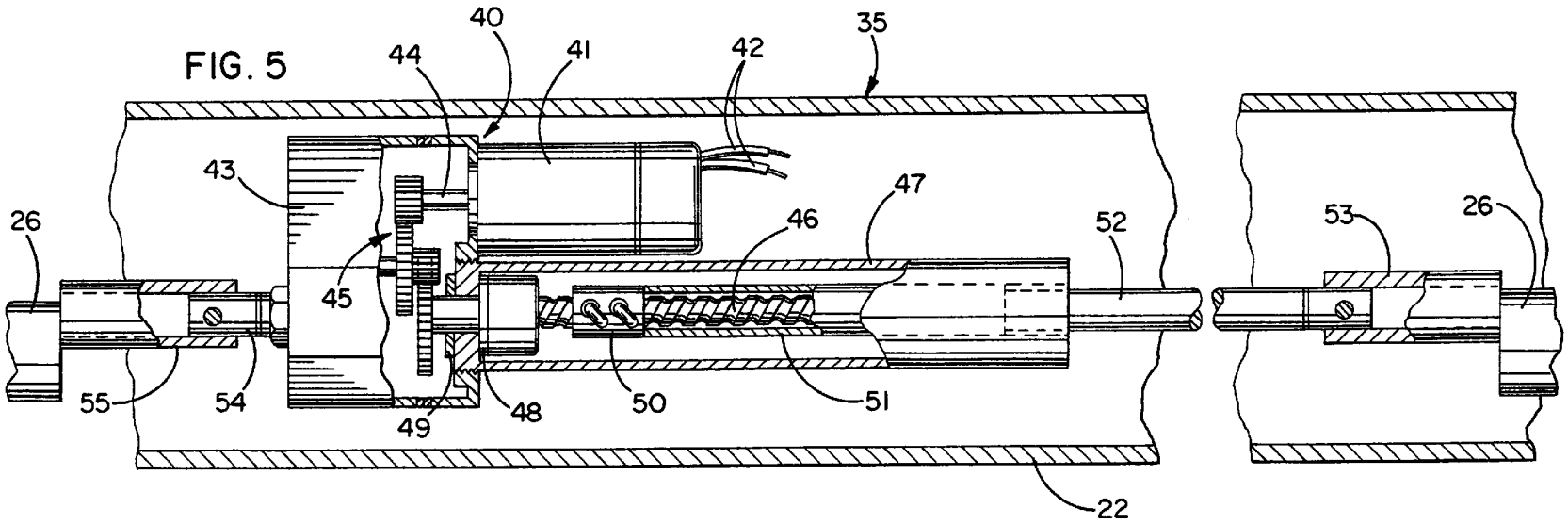
FIG. 5 is an enlarged view of certain components illustrated in FIG. 4, some of the components being broken away and shown in section.

In accordance with the present invention, the pins 26 are moved between their latched and unlatched positions by an electrically energized linear actuator 40 (FIGS. 4 and 5). By virtue of utilizing an electrical actuator to shift the pins, the coupler 10 may be quickly installed on the boom 12 since connection of the actuator to the electrical system of the vehicle is a relatively simple and easy matter.

More specifically, the actuator 40 includes a reversible d.c. motor 41 located within the housing 35 and having lead wires 42 (FIG. 5) adapted to be connected to the electrical system of the vehicle. The motor is supported on the outside of a gearbox 43 with its rotary output shaft 44 projecting into the gearbox and acting through a gear train 45 therein to rotate a laterally extending ball screw 46. The latter is journaled at its ends within a sleeve 47 attached to the gearbox 43, the screw being held against linear movement relative to the gearbox. Thrust collars 48 and 49 are fixed to the end of the screw adjacent the gearbox and engage opposite sides of the closed end of the sleeve.

Threaded onto the screw 46 is a ball nut 50 (FIG. 5) having one end attached to a tube 51 which, in turn, is attached to an elongated rod 52 extending out of the sleeve 47. The other end of the rod is telescoped into and is secured rigidly within a sleeve 53 which is attached to the inboard end of the right-hand pin 26. A shorter rod 54 is rigid with and extends from the gearbox 43 and is secured within a sleeve 55 which is attached to the left-hand pin 26.

Figure 6:
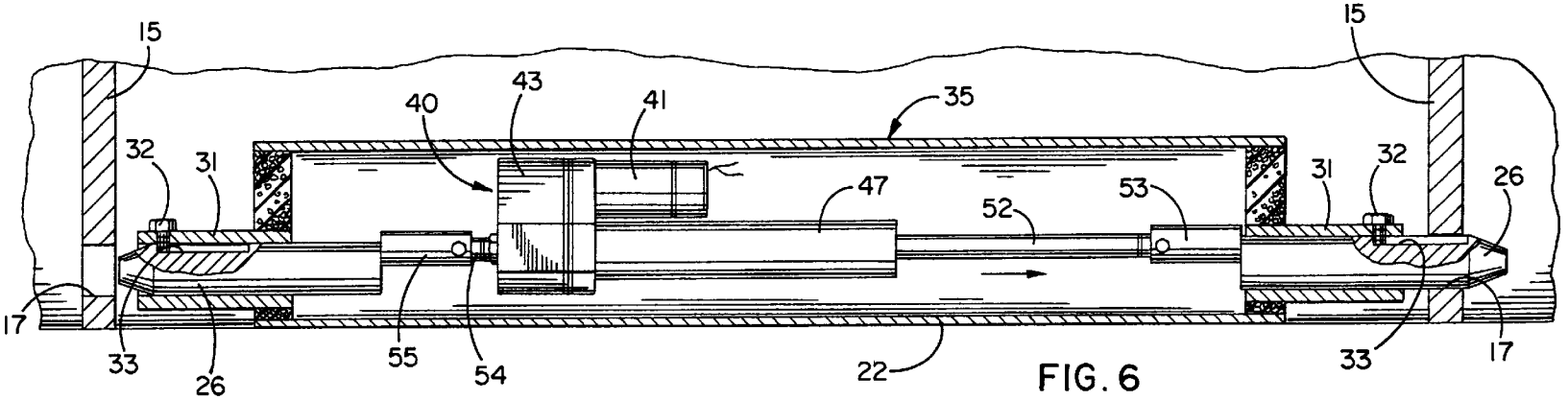
FIG. 6 is a view similar to FIG. 4 but shows one of the latching pins in a latched position.

FIGS. 4 and 5 show the components as positioned when the pins 26 are unlatched and are retracted from the holes 17 in the side plates 15 of the bucket 11. When the pins are unlatched, the ball nut 50 is positioned near the left end portion of the ball screw 46. To latch the pins, the motor 41 is energized so as to turn the screw in a direction to advance the nut from left-to-right. Being constrained against rotation by the screw 32 adjacent the right-hand pin 26, the nut 50 does in fact advance to the right and, in so doing, acts through the tube 51, the rod 52 and the sleeve 53 to shift the right pin 26 into the adjacent hole 17 and thus into a latched position (see FIG. 6).

When the inboard end of the slot 33 in the right pin 26 engages the adjacent screw 32, further advance of the nut 50 is prevented. With continued turning of the screw, the screw starts threading from right-to-left within the nut and causes the collar 48 to act through the sleeve 47, the gearbox 43, the rod 54 and the sleeve 55 to shift the left pin 26 to the left and into its latched position in the adjacent hole 17 (see FIG. 7). Depending upon friction, both pins 26 may start to advance to their latched positions simultaneously or one pin may start to advance before the other pin has been stopped by the associated screw 32.

Advantageously, the pins 26 are sufficiently long that they project a substantial distance through the holes 17 and beyond the outboard sides of the plates 15 when the pins are in their latched positions. Accordingly, the operator may easily see the end portions of the pins and visually determine whether the bucket 11 is safely attached to the coupler 10.

When the motor 41 is reversed, the screw 46 is turned in the opposite direction and retracts the nut 50 along the screw so as to withdraw the right pin 26 from the hole 17. When the outboard end of the slot 33 in that pin engages the adjacent screw 32, retraction of the nut is stopped so that further turning of the ball screw causes the screw to thread from left-to-right within the nut and unlatch the left pin 26. Again, both pins may start to unlatch simultaneously or one pin may start to unlatch before the other is fully unlatched.

From the foregoing, it will be apparent that the present invention brings to the art a new and improved implement coupler 10 in which the pins 26 are latched and unlatched upon energization of the electric motor 41 of the linear actuator 40. The motor may be electrically connected to the electrical system of the vehicle in a relatively quick and simple manner and thus the overall time required to install the power-actuated coupler is significantly reduced when compared to the installation time of couplers with hydraulically actuated pins.

I claim:

1. A coupling for use in detachably connecting a movable boom to the back side of an implement, said coupling comprising a bracket having means adapted for pivotal connection to said boom, said bracket having a pair of laterally spaced and laterally extending connectors adapted to be releasably coupled to said implement, a housing connected to said bracket and supporting said connectors to slide laterally inwardly to unlatched positions and laterally outwardly to latched positions, a reversible electrical motor located in said housing, a laterally extending screw supported for rotation and for linear movement in said housing, said motor being connected to said screw and being selectively operable to rotate the screw in either of two directions, a nut threaded on said screw and held against rotation relative to said screw whereby said nut translates along said screw when said screw is rotated, means coupling said nut to one of said connectors whereby translation of said nut is operable to move such connector between its latched and unlatched positions, said motor being movable linearly within said housing with said screw and being connected to the other of said connectors to move said other connector between its latched and unlatched positions when said motor is energized and said screw is rotated after said one connector has stopped in one of its positions.

2. A coupling for use in detachably connecting a movable boom to the back side of an implement, said coupling comprising a bracket having means adapted for pivotal connection to said boom, said bracket having a pair of laterally spaced and laterally extending connectors adapted to be releasably coupled to said implement, a housing connected to said bracket and supporting said connectors to slide laterally inwardly to unlatched positions and laterally outwardly to latched positions, a reversible electrical motor located in said housing, a laterally extending screw supported for rotation and for linear movement in said housing, said motor being connected to said screw and being selectively operable to rotate the screw in either of two directions, a nut threaded on said screw and held against rotation relative to said screw whereby said nut translates along said screw when said screw is rotated, means coupling said nut to one of said connectors whereby translation of said nut is operable to move such connector between its latched and unlatched positions, said motor being movable linearly within said housing with said screw and being connected to the other of said connectors to move said other connector between its latched and unlatched positions when said motor is energized and said screw is rotated after said one connector has stopped in one of its positions, and said coupler having laterally spaced side plates formed with laterally extending through holes which receive said connectors when said connectors are in said latched positions, said connectors being of sufficient length to extend beyond the outboard sides of said plates and to be clearly visible when said connectors are in said latched positions.

* * * * *